United States Patent [19]

Adams et al.

[11] Patent Number: 4,807,578

[45] Date of Patent: Feb. 28, 1989

[54] APPARATUS FOR CLEANING FUEL INJECTORS AND COMBUSTION CHAMBERS

[75] Inventors: Lawrence J. Adams, Jacksonville; Thomas R. Fruda, Green Cove Springs; Paul D. Hughett, Jacksonville, all of Fla.

[73] Assignee: Petro Chemical Corporation, Jacksonville, Fla.

[21] Appl. No.: 94,144

[22] Filed: Sep. 8, 1987

[51] Int. Cl.[4] ..... F02B 77/00

[52] U.S. Cl. ..... 123/198 A; 123/187.5 R

[58] Field of Search ..... 123/198 A, 187.5 R, 123/1 A; 137/315, 240; 354/324; 239/1, 533; 134/169 A, 95, 123

[56] References Cited

U.S. PATENT DOCUMENTS

| | | | |
|---|---|---|---|
| 2,711,725 | 6/1955 | Kovacs | 123/198 A |
| 2,792,008 | 5/1957 | Glenn | 123/198 A |
| 2,955,964 | 10/1960 | Glenn | 123/198 A |
| 3,945,366 | 3/1976 | Matthews | 123/198 A |
| 4,346,689 | 8/1982 | Neely | 123/198 A |
| 4,377,135 | 3/1983 | Abthoff et al. | 123/198 A |
| 4,512,587 | 4/1985 | Burke et al. | 123/187.5 R |
| 4,520,773 | 6/1985 | Koslow | 123/198 A |
| 4,606,311 | 8/1986 | Reyes et al. | 123/198 A |

*Primary Examiner*—Raymond A. Nelli

*Attorney, Agent, or Firm*—Lieberman, Rudolph & Nowak

[57] ABSTRACT

An apparatus for cleaning the fuel injectors and combustion chambers of an internal combustion engine. The apparatus can safely be used "under the hood" of the engine and features a safety fitting which is designed to mate only with a compatible container of cleaning mixture.

5 Claims, 8 Drawing Sheets

FIG. 4
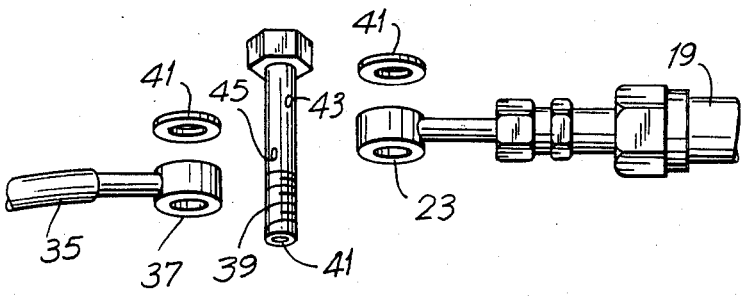
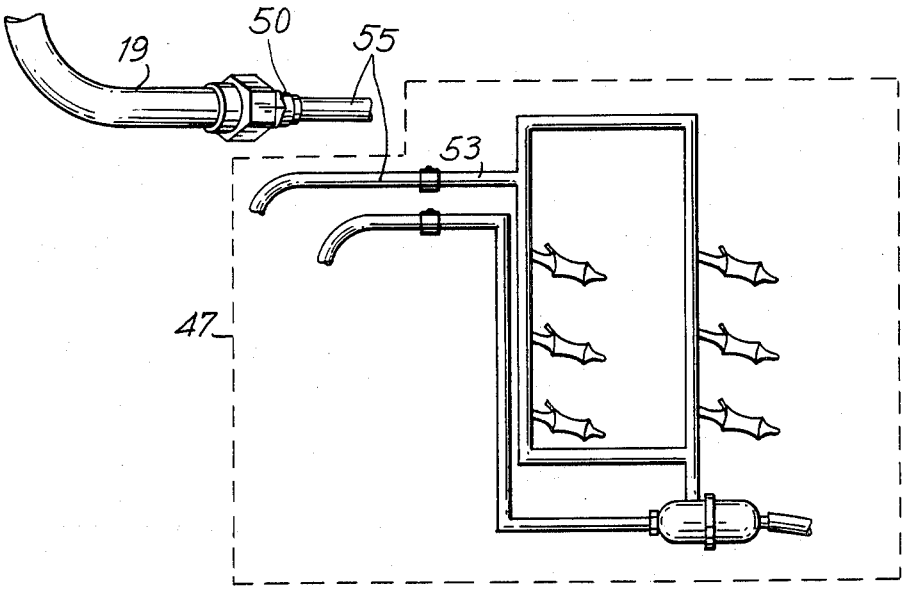
FIG. 5

FIG. 6
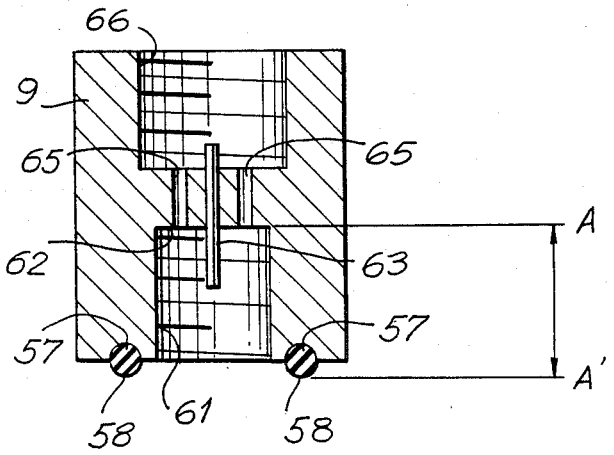
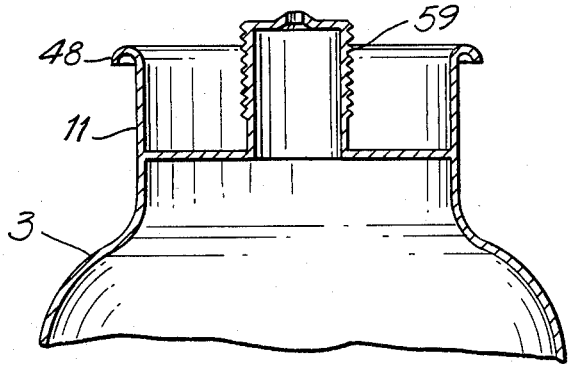
FIG. 7

FIG. 13
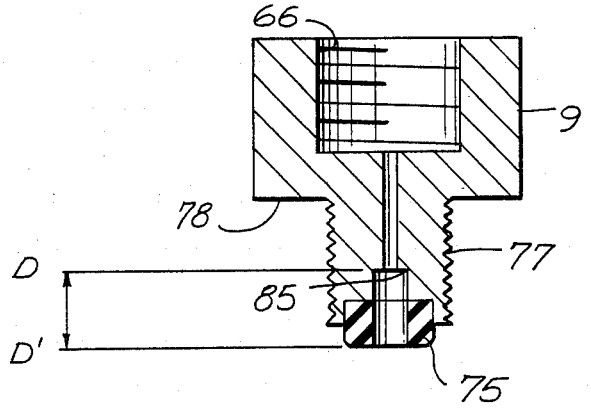
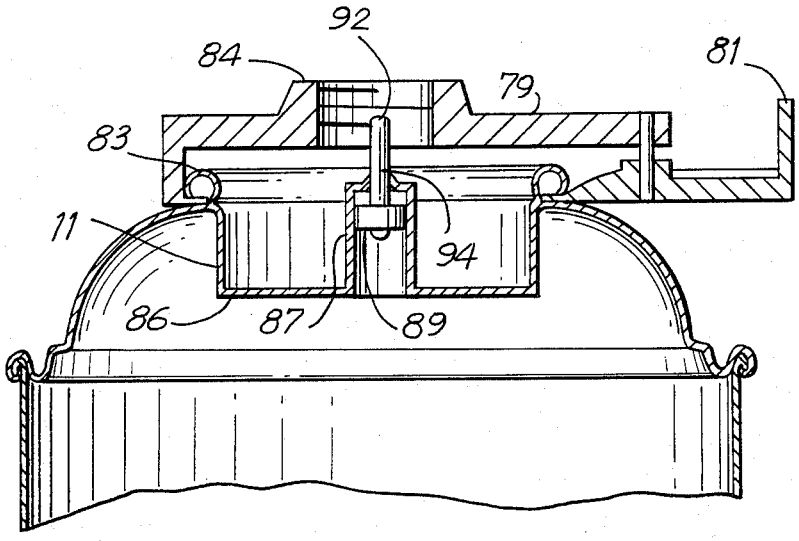
FIG. 14

APPARATUS FOR CLEANING FUEL INJECTORS AND COMBUSTION CHAMBERS

FIELD OF THE INVENTION

The invention relates to an apparatus for cleaning the fuel injectors and the combustion chambers of an internal combustion engine while the engine is operating. More particularly, the instant apparatus is self contained and carefully regulated and is designed to be safely used under the hood of a motor vehicle without completely disconnecting the fuel system or applying potentially damaging stress to the fuel system during the cleaning operation.

DESCRIPTION OF THE PRIOR ART

In order to maintain a fuel injected engine in top running condition, it is necessary to periodically clean its fuel injectors and the combustion chambers. Systems exist in the prior art which will accomplish this task, however none provide the safety and convenience of the instant invention. Such systems utilize various mixtures of gasoline, solvents and cleaners to clean the injectors. Some mixtures of this type are known in the art. One well known auto manufacturer cleans fuel injectors by connecting a hose from the fuel rail of the engine to a container into which is poured gasoline, and a solvent mixture. An ordinary bicycle pump is then used to force the mixture into the rail creating an extreme hazard to both the vehicle and the mechanic. Another method uses an aerosol mixture which connects directly to the engine's fuel injectors. This system does not attempt to regulate the injection pressure and thus is potentially dangerous when used under the hood of the motor vehicle. Other methods require that connectors which normally fasten the fuel line to the fuel injection rail be substantially disconnected in order to attach the required cleaning equipment, possibly causing damage to carefully placed engine parts. Certain systems require that the fuel supply or return lines be interrupted by "pinching" or bending the fuel line in order to prevent overheating and vapor lock caused by the mixture recirculating to the fuel tank. Such pinching is dangerous because the line can be cut or crushed, causing a leak or permanently blocking the fuel lines. Still another method requires that the entire fuel injection assembly be completely disconnected from the engine in order to perform the cleaning job.

It is therefore one object of the instant invention to provide an apparatus for cleaning engine fuel injectors which can be used "under the hood", without removing or substantially disconnecting components from the engine.

It is another object of the instant invention to provide an apparatus designed for safe and efficient use.

It is still another object of the instant invention to provide a pressure regulated cleaning apparatus to insure proper injection pressure into the engine rail during the cleaning procedure thereby eliminating the need to bend or "pinch" the fuel lines in order to avoid vapor lock.

SUMMARY OF THE INVENTION

In accordance with an embodiment of the instant invention, the fuel injector cleaning apparatus is comprised of a flexible high pressure hose, having attached to one end a rail fitting designed for attachment to the fuel rail of the subject vehicle. The other end of the hose is attached to an assembly comprising "in-line", a shut-off valve, a fuel filter, a pressure regulator and a safety fitting designed to safely mate with an aerosol container having a specially designed connector. The components of this assembly can be contained in a single housing or encapsulated into a single structure.

The aerosol container contains a mixture of fuel, and a well balanced blend of unique solvents, cleaners and propellent formulated to fuel and clean the engine during the cleaning operation.

The safety fitting is designed to interface with the connector of the aerosol container to minimize any danger that the volatile cleaning mixture might release into the air near the engine, during connection of the container or the cleaning operation.

The rail fitting is designed for attachment to the fuel line without seriously disturbing the engine's normal fuel line connection. Various rail fittings are used for different types of engines. For example, in many engines currently manufactured by Toyota, the engine's fuel line is attached to the cold start housing with a "banjo" type fuel fitting which is held in place by a union bolt which is drilled part way up through its center line and then cross-drilled to allow the fuel that is flowing through the fitting to enter the bolt through the cross-drilled portion and flow out the center of the bolt into the fuel rail. The instant invention provides a rail fitting for use with a Toyota engine which includes a second "banjo" fitting, designed to be placed above the one already in place, and a special double length or double union bolt which replaces the normal union bolt and holds both of the "banjo" fittings in place during the cleaning operation. This eliminates the need to move the existing fitting out of the way and possible damage to the vehicle's fuel line connector is thus avoided. The safety fitting is designed to mate with a compatible connector on the aerosol container and is designed to insure that the connection therebetween is sealed before the container's valve assembly is activated. In addition, the safety fitting is designed so that only a compatibly configured container can be used.

In certain embodiments of the invention, the threads of the safety fitting are recessed within its mating port. This type of fitting is designed to be used only with an aerosol connector having a specially extended threaded valve. The fitting is unusable with prior art valves because these valves are too short to reach the start of the threads of the mating port. By thus insuring that only correctly configured containers are used with the apparatus, control can be maintained over the contents of the container in order to assure that only a proper cleaning mixture is used with the apparatus.

The filter used in the apparatus is an "in-line" fuel filter designed specifically for fuel injectors which is manufactured by DELCO or other companies and is in the prior art. It serves to filter out any impurities present in the cleaning mixture.

The pressure regulator allows the user to set the pressure under which the cleaner is delivered to the fuel rail. The pressure is set to a level below that which would force open the engine's bypass fuel regulator, thereby preventing recirculation of the cleaning mixture into the fuel tank.

The apparatus can be used with various cleaning mixtures which are known in the art, and which will run the engine independent of the vehicle's fuel supply as the cleaning process takes place. A hanger is provided to allow convenient attachment of the apparatus to the hood of the vehicle.

It is, therefore, a feature of the invention to provide an apparatus for cleaning fuel injectors which is attached to the engine's fuel rail by connecting means designed to avoid damage to the normal fuel line connector.

It is another feature of the invention to provide a filtered and regulated supply of cleaner to the fuel rail.

It is still another feature of the invention to provide a safety means for connecting the supply of cleaner to the fuel rail in such a manner that the apparatus can be used safely "under the hood".

It is another feature of certain embodiments of the invention that the apparatus includes, and can only be used with, aerosol containers with lengthened valves, thus providing means for maintaining control over the contents of the container and assuring that only a proper cleaning mixture is used with the apparatus.

It is yet another feature of the invention to provide pressure regulator to allow the pressure of the incoming cleaning mixture to be set at the same pressure used for normal engine operations, thus preventing potentials damage to the engine systems.

These and other objects and features of the invention will be more fully appreciated from the following detailed description when taken in conjunction with the accompanying drawings.

BRIEF DESCRIPTION OF THE DRAWINGS

FIG. 4 describe the fuel rail fitting of an embodiment of the instant invention, designed for use with Toyota automobiles.

FIG. 5 describes the fuel rail fitting of an embodiment of the instant invention, designed for use with Nissan automobiles.

FIG. 6 is a cross-sectional view of one embodiment of the safety fitting.

FIG. 7 is a cross-sectional view of a connector on the aerosol container, designed to be compatible with the fitting of FIG. 6.

FIG. 13 is a cross-sectional view of a third embodiment of the safety fitting.

FIG. 14 is a cross-sectional view of a connector on the aerosol container, designed to be compatible with the fitting of FIG. 13.

DETAILED DESCRIPTION

Fuel injectors must be periodically cleaned in order to prevent clogging and consequentially poor engine performance. The instant invention is designed to provide the necessary cleaning in a safe and convenient manner.

Figure 1:
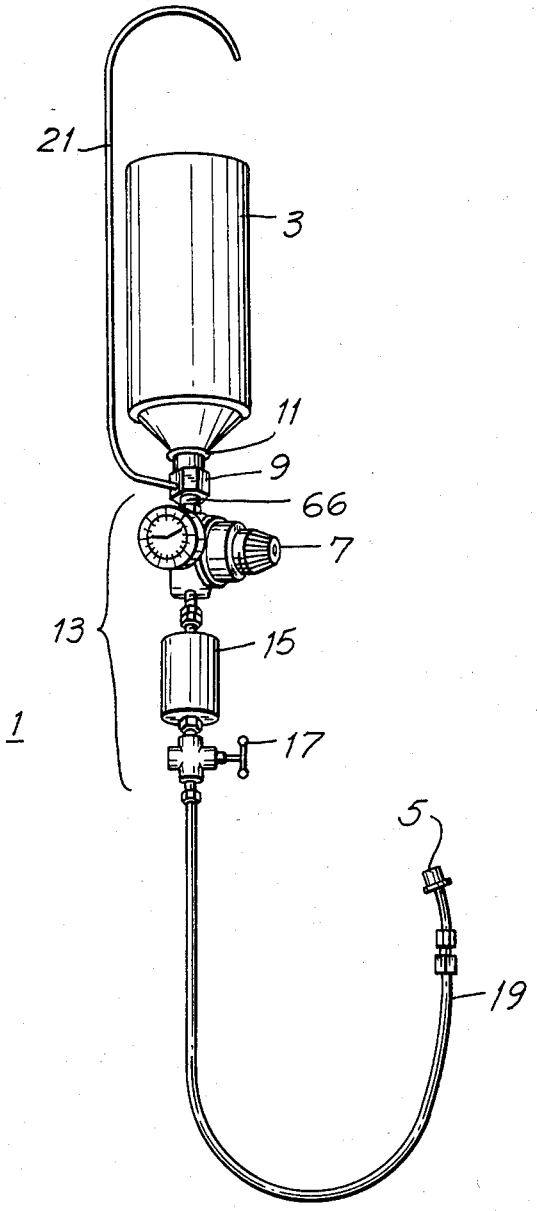
FIG. 1 describes one embodiment of the invention.

One embodiment of the instant invention is shown in FIG. 1. A cleaning mixture containing combustible substances and a blend of solvents, known in the prior art, is provided under pressure in aerosol container 3. The rail fitting 5 connects the assembly to the fuel rail or directly to the fuel injectors of the engine, depending on the model or manufacturer of the vehicle.

In a fuel injected engine, fuel is normally pumped from the fuel tank by an electric fuel pump, through a filter to the fuel injectors or to the fuel rail that feeds the injectors. This fuel is delivered at various pressures (as high as 75 PSI) depending on the manufacturer's design. A bypass regulator is located after the rail to keep unused fuel constantly recirculating back to the fuel tank. This prevents overheating of the fuel which can lead to vapor lock. In prior art injector cleaning systems, the fuel line is blocked leading to the bypass regulator and the cleaning mixture is pumped or otherwise propelled into the fuel injector system under substantial pressure which is unregulated. The unregulated pressure of the mixture supplied from an aerosol container for example, generally can be high enough to force open the engine's bypass regulator during the cleaning operation if not blocked. In such prior art systems, the operator is required to block this passage, such as by bending or pinching the fuel line. Pressure regulator 7 of an embodiment of the instant invention, however, permits the operator to set the pressure of the in-going mixture, just below the threshold opening pressure of the engine's bypass valve, which varies according to the manufacturer's design. This eliminates the need to pinch, bend or otherwise disable the vehicle's fuel lines in order to prevent potential damage to this system, plus the engine injector and combustion chambers are being cleaned without changing normal operating pressure specified by the manufacturer.

One embodiment of the instant invention is shown in FIG. 1. The safety fitting 9, connects the main assembly 13 to a compatible connector 11 of aerosol container 3. The filter 15, which is a readily obtainable prior art in-line fuel filter, filters the cleaning mixture before it enters the engine. The shut off valve 17 allows the mechanic to halt the flow of cleaning mixture until the proper pressure is set using the regulator 7. Connecting hose 19 is a high pressure hose made from a suitably strong, generally flexible material which is impervious to strong solvent systems. The material can be of a textile and thread composition such as Buna intercore reinforced with nylon. The hanger 21 is used to suspend the apparatus 1 from the inside of the hood of the vehicle during the cleaning operation.

Figure 2:
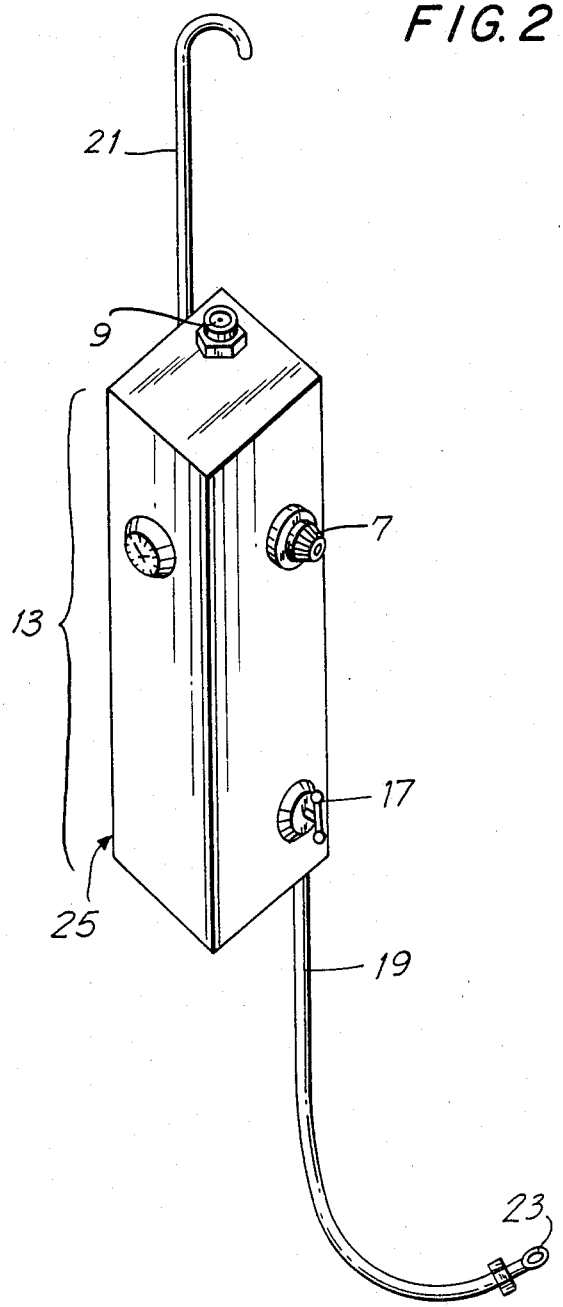
FIG. 2 is an perspective view of a second embodiment of the invention.

FIG. 2 describes the embodiment shown in FIG. 1, with the main assembly 13 encapsulated in a plastic or otherwise suitably hard material, or enclosed in a unitary package 25. The unitary package provides access to the pressure gauge and adjustment knob of the pressure regulator 7, safety fitting 9 and shut-off valve 17. The rail fitting 23 shown in FIG. 2 is of the type used for currently available Toyota engines and most other foreign automobiles except Nissan and is described in more detail in FIG.4.

Figure 3:
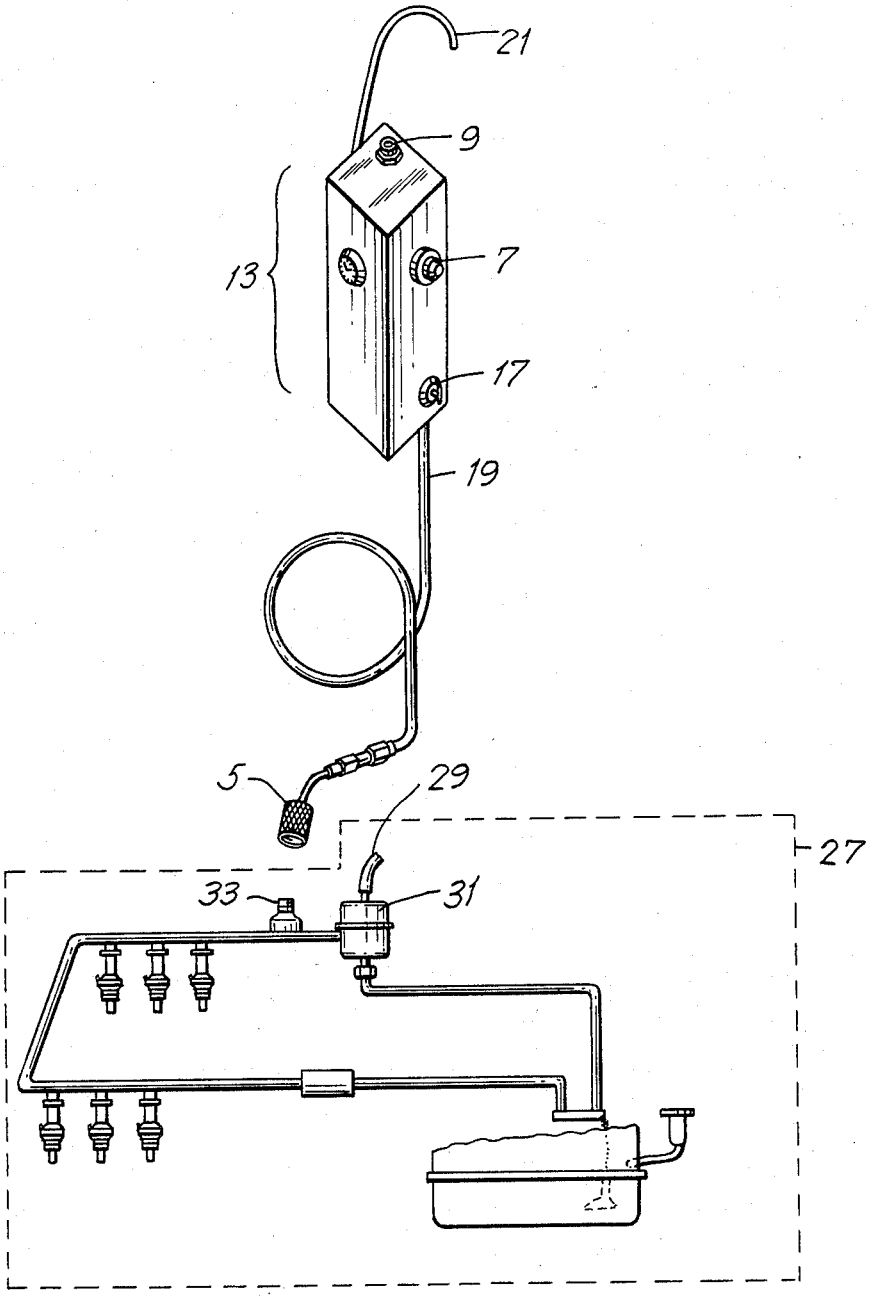
FIG. 3 describes the embodiment of FIG. 2 configured for use with Ford, GM and Chrysler automobiles.

FIG. 3 describes the embodiment of FIG. 2 as configured for use with current Ford, GM, or Chrysler products. A fuel system of an engine is shown in the block labelled 27. The apparatus is used as follows:

(1) The fuel pump (not shown) is electrically disconnected from the fuel system 27, while the engine is running. The engine will then stall.

(2) The vacuum line 29 is disconnected from the fuel system's pressure regulator 31. Disconnecting the vacuum line permits the operator to set the regulator 7 at the same pressure for the cleaning mixture as the manufacturer recommends for fuel operation.

(3) The appropriate rail fitting 5 is connected to the engine's fuel pressure gauge test point 33 located on the fuel rail. On current GM and Chrysler engines the fittings are ⅜", on current Ford engines they are ¼".

(4) The knob of regulator 7 is turned counter-clockwise to the "off" position to close the regulator and at the same time close shut-off valve 17.

(5) Aerosol container 3 (as shown in FIG. 1) is coupled to into safety fitting 9, making sure that the connector 11 of the container 3 is fully seated on the safety fitting 9 (as explained in more detail below).

(6) The assembly 13 is hung high on the open hood using hanger 21.

(7) The pressure regulator 7 is adjusted to the pressure (PSI) recommended for the make and model of the engine.

(8) The shut-off valve 17 is then opened.

(9) The engine is started and engine RPM is set to approximately 2,000.

(10) The cleaning mixture will fuel the engine and clean the injectors and combustion chambers until the container 3 is empty at which point the engine will stall.

(11) After the engine stalls, the rail fitting 5 is disconnected and the vacuum line 29 is reconnected. The fuel pump is then electrically reconnected.

FIG. 4 is a detailed view of the rail fitting 23 of the instant invention which can be used for example with current Toyota engines. In the Toyota, the engine's fuel line 35 is attached to the cold start housing at the engine with a "banjo" type fuel fitting 37 which is held in place by union bolt (not shown) drilled part way up through its center line and then cross-drilled to allow the fuel that is flowing through the fitting to enter the bolt through the cross-drilled portion and flow out the center of the bolt into the fuel rail. One embodiment of the instant invention provides a "banjo" rail fitting 23 which can be used with a Toyota engine and is designed to be placed above the vehicle's gas supply "banjo" fitting 37. A special double length union bolt 39 replaces the normal bolt and holds both of "banjo" fittings 37 and 23 in place during the cleaning operation. The double length union bolt 39 is cross-drilled in two places, 43 and 45, and is drilled part way up through its center 41 to allow the cleaning mixture to flow from hose 19 into the cold start housing while maintaining the normal connection of fitting 37. Copper "O" ring seals 41 are used to secure a leak free connection. The use of bolt 39 eliminates the danger of damaging the vehicle's gas supply fitting 37 and the fuel line 35 because the line 35 does not have to be moved or bent out of the way in order to connect the apparatus. The normal fuel line connection is maintained through opening 4 of the double length bolt 39 and the cleaning mixture is dispensed through opening 43. With the exception of the different type of rail fitting, the method of use of the instant invention is the same as that outlined in steps 1–11, above.

FIG. 5 is a detailed view of the rail fitting 50 of the instant invention which can be used for example with current Nissan engines. With the current Nissan fuel injection system 47, the hose 19 of the instant embodiment is connected to the high pressure side of the fuel rail 53 by a ⅜" flexible hose 55. With the exception of the different type of rail fitting, the method of use of the instant invention is the same as that outlined in steps 1–11, above.

The safety fitting 9 has a substantially circular configuration as shown in FIG. 2. The fitting is designed to establish a leak proof seal between the connector 11 of container 3 and regulator 7, *before* the valve of connector 11 is opened.

One embodiment of fitting 9 is shown in a detailed cross-sectional view in FIG. 6. The safety fitting 9 has two ends. One end includes an output port 66 which threads, or similarly couples securely to the pressure regulator 7, as shown in FIG. 1. The second end of the fitting 9 is partially formed into a cylindrical threaded mating port 61 having a fixed depth and diameter. The threads of the mating port 61 are recessed within the port. Prior art threaded valves (not shown), are generally more recessed within the edge of the connector of the aerosol container and are shorter in length than the instant valve 59. They, therefore, cannot be used with the instant mating port 61 because they will not reach the threads of the port 61. The instant mating port 61 will only successfully mate with a lengthened valve 59 which extends beyond lip 48 of the connector 11, as shown in FIG. 7. Disposed on the end of the fitting 9 surrounding the opening of port 61, is a generally compressible "O" ring 57 having a convex portion 58 extending beyond the end of the fitting 9.

Figure 8:
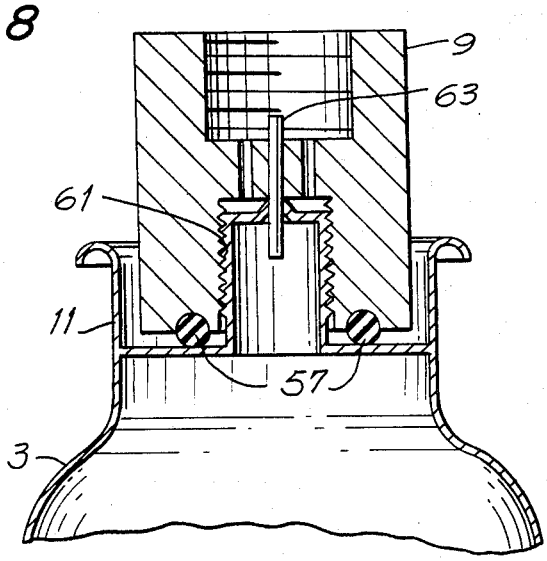
FIG. 8 is a cross-sectional view of the fitting of FIG. 6 shown connected to the connector of FIG. 7.

Line A—A' represents the distance between the base 62 of port 61 and the outermost convex portion 58 of "O" ring 57, i.e. that portion which is furthest from the base 62. Dual channel 65 passes the cleaning mixture through fitting 9 and has disposed within, and partially protruding from it an actuating pin 63. FIG. 7 shows a cross-sectional view of connector 11 of container 3. The connector 11 features a "female" aerosol valve 59 which is longer than similar prior art valves. Valve 59 partially extends beyond the lip 48 of connector 11 as part of the instant invention. Only a container 3 having a connector 11 with the lengthened valve 59, can be successfully and safely used with fitting 9. The safety fitting 9 combined with lengthened valve 59 comprises a fastening means which assures that only a proper cleaning mixture is introduced into the fuel injection system. Valve 59 is threaded and is compatible with port 61 so that they can be threaded together as shown in FIG. 8. The distance described by line A—A' is grater than the length of valve 59 so that the "O" ring 57 of safety fitting 9 must be firmly seated, compressing slightly around valve 59 before pin 63 of fitting 9 can enter and open valve 59, as shown in FIG. 8. A safety seal is thus created to prevent leakage of the pressurized mixture and its contact with the hot engine.

Figure 9:
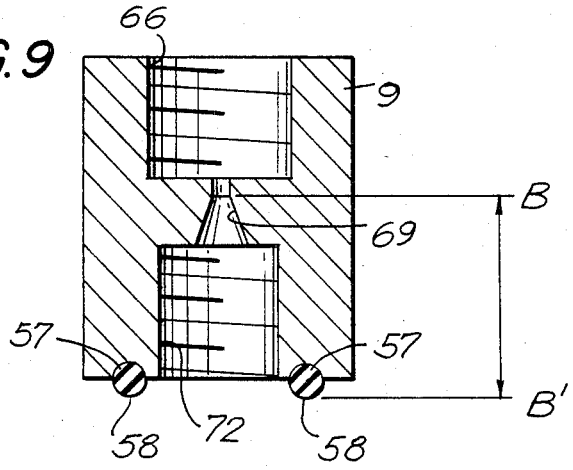
FIG. 9 is a cross-sectional view of a second embodiment of the safety fitting.
Figure 10:
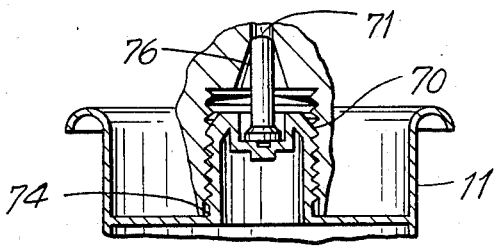
FIG. 10 is a cross-sectional view of a connector on the aerosol container, designed to be compatible with the fitting of FIG. 9.

FIG. 9 describes a second embodiment of the safety fitting 9 of the instant invention. Similar to the embodiment of FIG. 7, fitting 9 has a mating port 72 which has recessed threads. Instead of an actuating pin however, port 72 features a channel 69 having partially oblique edges. This embodiment is used with a lengthened threaded "male" aerosol valve 70, which extends beyond lip 48 of the connector 11, as shown in FIG. 10, and which is compatible with port 72. As in the embodiment discussed immediately above, the recessed threads of port 72 prevent its use with prior art valves which are shorter than valve 70 and which are generally more recessed within the aerosol connector Valve 70 has a valve actuating member 71 which opens valve 70 when partially depressed. The safety fitting 9 combined with lengthened valve 70 comprises a fastening means which assures that only a proper cleaning mixture is introduced into the fuel injection system.

Line B—B′ represents the distance from the base of the oblique portion of the channel 69 to the outermost convex portion 58 of "O" ring 57. The distance B—B′ is longer than the length of valve 70 including actuating member 71, so that only when "O" ring 57 is firmly seated, compressing slightly around valve 70, will the oblique edges of channel 69 depress the valve actuating member 71 thereby opening valve 70. Thus a safety seal is created against gases which might come into contact with the hot engine.

Figure 11:
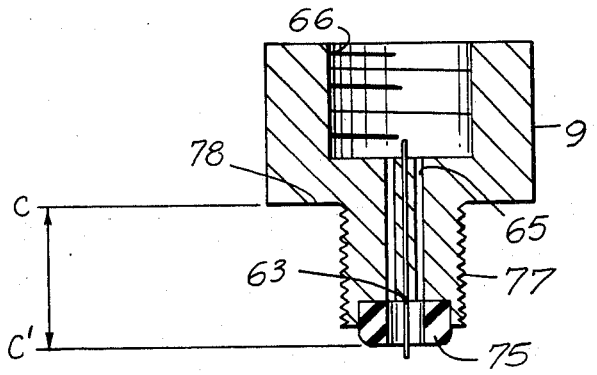
FIG. 11 is a cross-sectional view of a third embodiment of the safety fitting.
Figure 12:
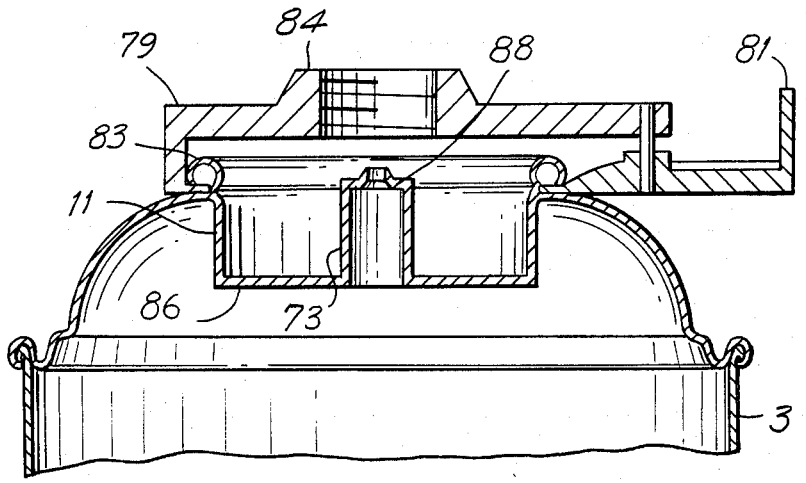
FIG. 12 is a cross-sectional view of a connector on the aerosol container, designed to be compatible with the fitting of FIG. 11.

FIG. 11 describes a third embodiment of the safety fitting 9 of the instant invention. This embodiment is designed to be used with an un-threaded "female" aerosol connector 73, as shown in FIG.12. In this embodiment, safety fitting 9 features a threaded protruding portion 77 which is partially rimmed with a generally hemispherically shaped "O" ring 75. An adapter 79, which is threaded to receive threaded portion 77, is clamped onto the neck 83 of connector 11 and held in place by a pivoting lever 81. Adapter 79 is known in the art. As in the embodiment shown in FIG. 6, channel 65 has an actuating pin 63 disposed within, and slightly protruding from it.

Line C—C′ represents the distance from the base 78 of portion 77 to outermost convex portion of "O" ring 75. Fitting 9 is designed so that distance C—C′ is greater than the distance between the top end 84 of adapter 79 to the base 86 of connector 11, so that "O" ring 75 must be completely seated and slightly compressed around the top 88 of valve 73, before pin 63 can open valve 73, thus creating a safety seal against gases which might come into contact with the hot engine.

FIG. 13 describes a fourth embodiment of the safety fitting 9 of the instant invention. This embodiment is designed to be used with an un-threaded "male" aerosol valve 87, as shown in FIG. 14. As in the previously described embodiment above, the threaded protruding portion 77 of the safety fitting 9 screws into adapter 79. In this embodiment however, safety fitting 9 has no pin, but instead features a channel with terraced edges 85. Valve 87 is fitted with a valve actuating member 89 which opens valve 87 when depressed.

Line D—D′ represents the distance between the terrace portion of channel 85 and the outermost convex portion of "O" ring 75. Distance D—D′ is greater than the length of the exposed length 94 of valve actuating member 89. Therefore, the terraced edges of channel 85 will depress valve actuating member 89 and open valve 87 only after "O" ring 75 is completely seated and slightly compressed around the rim of valve 87, thus creating a safety seal against gases which might come into contact with the hot engine.

The "O" rings 57 and 75 shown in the above drawings can be made from generally flexible and non-reactive materials such as rubber, nylon, PVC and other suitable materials known in the art.

Although not shown in the drawings, the embodiment of the instant invention shown in FIG. 2 can additionally feature a snap-in front panel for displaying the name of the manufacturer of the engine, or the customer, recessed pockets containing valve, gauge and pressure regulator controls, one way screws to prevent disassembly, double nut locking for attaching the hose 19 to assembly 13, and internal ribbing within the unitary housing 25, for increased strength.

The foregoing disclosure and description of the invention is illustrative and explanatory thereof and various changes in the size, shape, and materials as will as in the details of the illustrated construction may be made within the scope of the appended claims without departing from the spirit of the invention.

What is claimed is:

1. Apparatus for cleaning the fuel injectors and combustion chambers of an internal combustion engine with a cleaning mixture, said apparatus comprising:

(a) a cleaning mixture transfer device having first and second ends;

(b) a fuel rail fitting attached to said first end of said transfer device;

(c) a pressure regulator attached to second end of said transfer device;

(d) an aerosol container for containing said cleaning mixture, said container having a connector with a valve;

(e) a safety fitting having first and second ends, said first end of said fitting attached to said pressure regulator, said second end of said fitting having a generally compressible "O" ring disposed thereupon, said "O" ring having a convex portion protruding from said second end, which compresses when said second end is connected to said connector, thereby creating a seal around said valve before said valve is opened, said transfer device further including a shut of valve;

(f) said cleaning apparatus configured for use with an engine having a gas supply fitting, which is of the type known as a banjo fitting, a bolt for removably fastening said gas supply banjo fitting, and said fuel rail banjo fitting proximate to each other and said engine, said bolt being drilled partially up through its center line and cross-linked in two places, each of said cross-drilled places facing one of each of said banjo fittings to as to permit the flow of said cleaning mixture into said engine without disturbing said gas supply fitting; and (g) said apparatus further comprising means to suspend said apparatus from the open hood of the automobile during the cleaning operation, safely away from high engine temperatures and moving parts.

2. A safety fitting in accordance with the apparatus of claim 1 wherein said valve of said apparatus is threaded, said fitting comprising:

a substantially cylindrical threaded mating port recessed within its second end which is compatible with said valve, said port having an actuating pin disposed therewithin, said port having a depth which, when added to the length of the convex portion of said "O" ring, is greater than the length of the valve, whereby when said port is threaded onto said valve, said "O" ring must firmly seat forming a complete seal around said valve before said pin of said port can open said valve.

3. A safety fitting in accordance with the apparatus of claim 1 wherein said valve of said apparatus is threaded, said valve having a valve actuating member, said fitting comprising:

a threaded mating port recessed within its second end, which is compatible with said valve, said port having a channel with partially oblique edges disposed therewithin, the distance from said oblique edges to the outermost convex portion of said "O" ring being greater than the length of said valve including said valve actuating member, whereby when said port is threaded onto said valve, said "O" ring must firmly seat forming a complete seal around said valve before said oblique edges of said contact and depress said actuating member thereby opening said valve.

4. A safety fitting in accordance with the apparatus of claim 1 wherein said valve of said apparatus is un-threaded, said container having a threaded adapter removably affixed thereto, said fitting comprising:

a threaded protruding portion as its second end which is compatible with said adapter, said protruding portion having an actuating pin disposed therewithin, a portion of said pin extending slightly out of said protruding portion, said protruding portion having a length which, when added to the convex portion of said "O" ring, is greater than distance from the top of said adapter to the rim of the valve, whereby when said protruding portion is threaded into said valve, said "O" ring must firmly seat forming a complete seal around said valve before said pin of said port can open said valve.

5. A safety fitting in accordance with the apparatus of claim 1 wherein said valve is un-threaded and includes a valve actuating member having an exposed length, said container having a threaded adapter removably affixed thereto, said fitting comprising:

a threaded protruding portion as its second end which is compatible with said valve, said container having a threaded adapter removably affixed thereto, said protruding portion having a channel with terraced edges disposed therewithin, the distance from said terraced edges of said channel to the outermost convex portion of said "O" ring being greater than the length of the exposed length of said actuating member of said valve, whereby when said protruding portion is threaded into said adapter, said "O" ring must firmly seat forming a complete seal around said valve before said terraced edges of said channel can contact and depress said actuating member thereby opening said valve.

* * * * *

UNITED STATES PATENT AND TRADEMARK OFFICE

CERTIFICATE OF CORRECTION

PATENT NO. : 4,807,578

DATED : February 28, 1989

INVENTOR(S) : Lawrence J. Adams, Thomas Fruda, Paul D. Hughett

It is certified that error appears in the above-identified patent and that said Letters Patent is hereby corrected as shown below:

Title page change the Assignee from "Petro Chemical Corporation" to-Petro Chemical Products, Inc.-

Signed and Sealed this

First Day of December, 1992

*Attest:*

DOUGLAS B. COMER

*Attesting Officer*

*Acting Commissioner of Patents and Trademarks*